US005282660A

United States Patent [19]

Halling

[11] Patent Number: 5,282,660

[45] Date of Patent: Feb. 1, 1994

[54] SEALABLE CONTAINER FOR SANITARY COLLECTION OF MATTER, PARTICULARLY ANIMAL DROPPINGS

[76] Inventor: Martha G. Halling, 12 Riverdale Ave., Ormond Beach, Fla. 32174

[21] Appl. No.: 968,348

[22] Filed: Oct. 29, 1992

[51] Int. Cl.[5] ..... A01K 29/00; E01H 1/12

[52] U.S. Cl. ..... 294/1.3; 15/257.1

[58] Field of Search ..... 294/1.3, 1.4, 1.5, 55.25; 15/257.1, 257.9; 383/6, 11, 52

[56] References Cited

U.S. PATENT DOCUMENTS

| | | | |
|---|---|---|---|
| 3,676,887 | 7/1972 | Klein . | |
| 3,739,418 | 6/1973 | Yonaites et al. | 294/1.3 |
| 3,978,540 | 9/1976 | Peck et al. . | |
| 4,132,442 | 1/1979 | Larsson . | |
| 4,252,356 | 2/1981 | Tokozumi . | |
| 4,741,565 | 5/1988 | Bagg . | |
| 4,836,594 | 6/1989 | Spreiter . | |
| 4,838,327 | 6/1989 | Ambler et al. . | |

FOREIGN PATENT DOCUMENTS

| | | | |
|---|---|---|---|
| 1082251 | 7/1980 | Canada | 294/1.3 |
| 0037355 | 10/1981 | European Pat. Off. . | |
| 3326305 | 8/1984 | Fed. Rep. of Germany . | |
| 3909418 | 11/1989 | Fed. Rep. of Germany . | |
| 2649143 | 1/1991 | France | 294/1.3 |
| 661077 | 6/1987 | Switzerland . | |
| 2008345 | 5/1992 | World Int. Prop. O. | 294/1.3 |

*Primary Examiner*—David M. Mitchell
*Assistant Examiner*—Dean J. Kramer

[57] ABSTRACT

This invention provides a bag or container for the sanitary collection or storage of items comprising: (a) a bag having a sealable opening at the top thereof, (b) a pair of cooperating, substantially rigid scooping members, each having a griping end and a scooping end, and each attached in the vicinity of their gripping end to opposite walls inside of the bag with their scooping ends directed downwardly to the inside bottom of the bag, to enable gripping of the scooping members at their gripping end, (c) the attachment of the griping end being in the vicinity of the mouth of the bag whereby the scooping members are adapted to be gripped from the outside of the bag and the scooping ends pivoted from their position of being directed downwardly to the inside of the bag bottom to a position upwardly and out of the opening of the bag, and further adapted to scoop items up by the cooperating scooping members, and the item and scooping members then pivoted back into the bag.

14 Claims, 4 Drawing Sheets

SEALABLE CONTAINER FOR SANITARY COLLECTION OF MATTER, PARTICULARLY ANIMAL DROPPINGS

BACKGROUND OF THE INVENTION

The present invention relates to a container for the sanitary collection, storage and/or disposal of items, such as waste, debris, specimens or evidence.

It should be understood that the term "item" is used in its broader sense as referring generally to contaminants, wastes, specimens, evidence at the scene of a crime and similar items. This invention has particular utility with respect to the removal of animal excrements.

The container contains scooping members which are inside of a sealable container so that a gooey or smelly item can be completely sealed inside the container together with the soiled internal scooping members. The entire sealable container may then be carried for some distance and/or for some time, to a final destination without fear of spillage, escape of the item or its unpleasant odor, or contamination of the item or of the transporter. With regard to cleaning up animal excrement and transporting it to a disposal point, once the first and/or the second excrement is picked up and the container is sealed, the container can be placed in the bottom of, e.g., a baby stroller, or inside a carrying bag, without fear of contaminating anything surrounding or nearby to the baby stroller or carrying bag.

An embodiment of the container can be structured so that the container can be used for more than one pick-up.

The scooping members are attached so that their scooping ends are sealed inside the container. The handle portion end of the scooping members either protrude through the side of the container material or the handle portion is entirely inside the container and is adapted to be easily grasped from the outside of the container. By use of the handle, the scooping members are rotated or pivoted out of the mouth of the container, from the inside of the container, and returned by a reverse rotation or pivoting during the pick-up procedure. This also prevents the mouth of the container from becoming soiled.

Since the scooping members are attached inside the container at a point recessed down from the opening of the container, there is a great deal of flexibility, control, and preciseness in their use. The scooping members may be used to brush, push and/or scrape an item by one scoop onto the other scoop, or the scoops may be used in cooperation one-with-the other in a sort of pincer movement in order to pick up an item.

The invention can be reused very easily for a second pickup. The reuse option is necessary when, e.g., a dog defecates more than once during a walk period, and the walker only has one device with them.

The scooping members are attached at a point relatively adjacent to the opening or mouth of the container so that the scooping members can be grasped from the outside of the container and rotated about the point of attachment to project the scooping ends of the scooping members out of the container and then, after use, back into the container.

The invention is extremely simple to manufacture, package, store and use.

The pockets in the container side(s) around the gripping end(s) of the scooping members facilitate the grasping of the scooping member, their rotation in and out of the container mouth, and the scooping up of debris.

DETAILED DESCRIPTION

Figure 1:
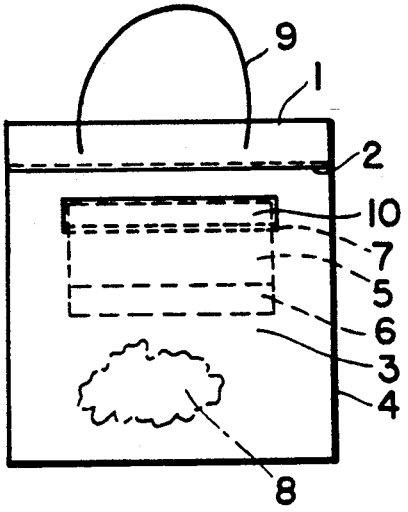
FIG. 1 is a plan view of an example of the container of this invention. In this embodiment a substantially flexible container may be made of transparent or non-transparent material. After use, opening 1 of the container can be sealed 2 shut. The two preferably rigid scooping members 5 and 6 are opposite, one of the other, and are attached so as to be sealed inside the flexible container at area 7 and the opposite side of the container at area 7', and/or at areas 10 and 10' respectively. The top of the container is sealable at 2. This may be done, e.g., with sticky adhesive material, flare/-ridges such as in Glad Bags, or Velcro or any other sealable methodology as is well known in the art. In another embodiment, the container may have a handle(s) 9 to help in its transportation. Number 4 shows the container side seam.

FIG. 1 is an embodiment of a substantially flexible container which may be made of transparent or non-transparent material. This container could be similar to the reclosable and/or resealable storage bags which are on the market today. The opening 1 of the container can be sealed shut, 2. This can be accomplished, e.g., by the use of adhesive, velcro, or sealable seams, with one side being pressed inside the opposite cavity side of the other. The container could have flexible or semi-flexible sides 3 and 3'. Or, only portions of the container side may be flexible. For example, the portion around the gripping ends of the scoopers may be more flexible to facilitate grasping and moving of the scooping member. The container may be made of various sizes, so that the container could flex open so as to accommodate the different sizes of items of pick-up. The container may also be made of a material that is appropriate for the intended use. If the container is being used to pick up gooey or smelly items, it can be made of a non-porous material. However, if the container is being used to pick up a living specimen, e.g. insects or plant material the container may instead be made of a porous material so that the specimen may breathe.

There are two rigid scooping members 5 and 6 attached inside the container at areas 7 and 7' and/or 10 and 10'. In the preferred embodiment one of the scooping members 5 or 6 is shorter than the other 5 or 6. This difference in sizes of the scoopers 5 and/or 6 facilitates the brushing, scooping, and/or pushing of the item to be picked up, by the smaller scooping member onto the larger scooping member. This, also makes it easier to get the scooping members, into, and out of, the container.

In another embodiment both of the scooping members 5 and 6 may be of the same length if appropriate for the item being picked up.

Opposite the scooping ends of the scooping members 5 and 6, are the handle ends, 10 and 10'. They are encased by the material of the container and also may protrude therefrom.

If the handle ends protrude from the container side they are either still encased by the container side or are sealed to the opening in the container side through which they protrude.

4 is the seamed side of the container and 8 is the item being pick-up.

The optional attached handle 9 facilitates the carrying of the container.

Figure 2:
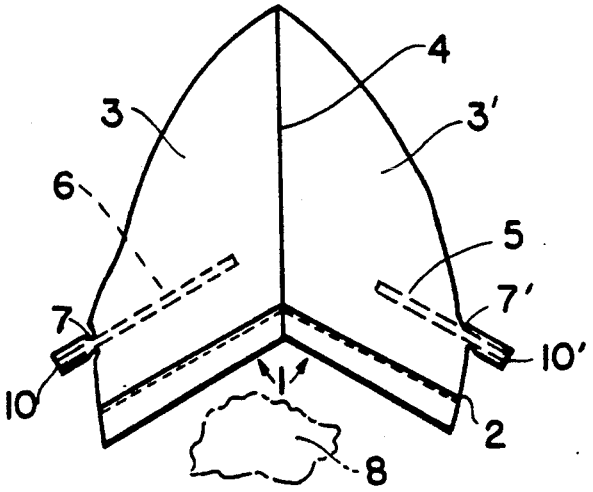
FIG. 2 is a side view of the container with the seamed side 4 of the container showing. The scooping members 5 and 6 are still within the container; 3 and 3' show opposite sides of the container. In this embodiment the gripping portion of the scooping members 5 and/or 6 protrude outside of the container side, but are enclosed by the container wall, and form the gripping areas 10 and 10'.

FIG. 2 is the container with the opening facing downward for a pick-up operation. The scooping members 5 and 6 are still inside the opening or mouth of the container.

In this preferred embodiment the gripping end 10 and 10' of the scooping members 5 and 6 are flat and are sealed in the sides 3 and 3' of the container and protruding outwardly of the side of the container. This would allow for easy grasping, gripping, and/or manipulation. Since the scooping members 5 and 6 in this embodiment are flat, packaging, storing and assembling would be very easy.

Figure 3:
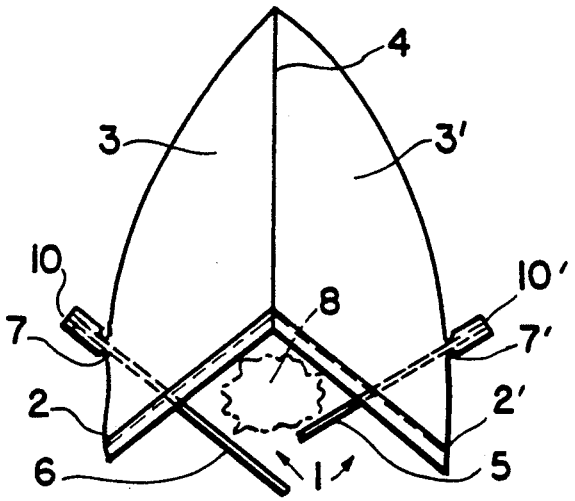
FIG. 3 is a side view of the seamed side 4 of the opened container. The scooping members 5 and 6 are shown in a position rotated or pivoted out of the container through its wide mouth and being used to pick up debris matter item 8. In another embodiment of the invention, one scooping member may be shorter than the other. Thus one scooping member 5 and/or 6 may be used to push and/or brush the item onto the other scooping member 5 and/or 6. As the scooping members are rotated and/or pivoted in a direction back into the container, item 8 drops into the container. When the scooping members are fully rotated back into the container upon completion of the pick-up, the need to deal with or touch the soiled scoopers is eliminated.

FIG. 3 is the container with the opening 1 facing downward over the pick-up area. The gripping edges 10 and 10' have been rotated and/or pivoted so that the scooping members 5 and/or 6 are now out of the mouth of the container. The scooping members are being used to scoop-up item 8 by scoop 5, onto the face of scoop 6.

Figure 4:
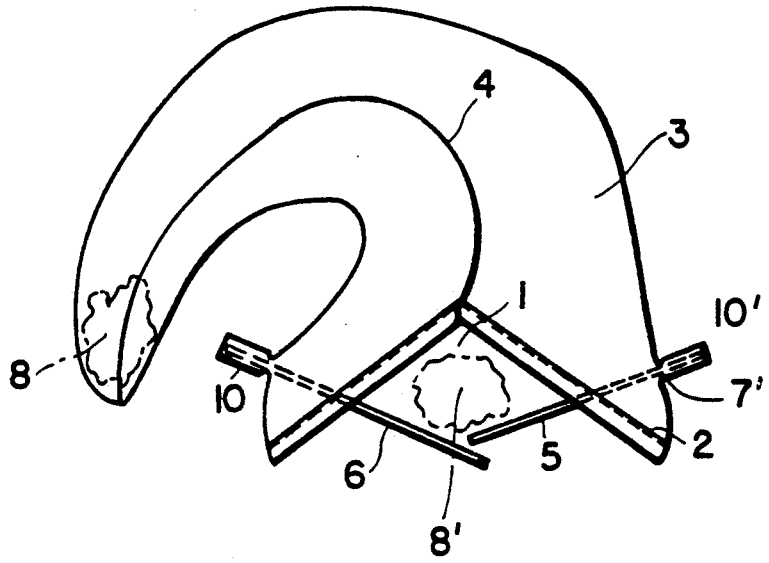
FIG. 4 is another embodiment of the invention showing an elongated container of such a length that it can be folded over. When soiled matter, item 8, falls into the bottom of the container, the bottom portion of the container can be folded over so that the item will remain at the bottom of the container while the container is being reused for a second pick-up. Thus, the item 8 first picked up will not interfere with the reuse of the scoops 5 and 6 to pick up a second item 8'.

FIG. 4 is the container with the opening 1 facing downward over the pick-up area. Scoops 5 and 6 are shown in the process of picking up the second item 8'. In this embodiment of the invention the container is fashioned long enough and flexible enough so that the first item 8 may fall into the bottom portion of the container. This bottom portion is flexible enough and long enough so that it may be flapped and/or folded over. Thus, when the container is reused to make a second (or third) pick-up for item(s) 8 or 8', the previously picked-up item(s) are contained and held within the container and do not fall out nor interfere with scooping members 5 and 6.

Figure 5:
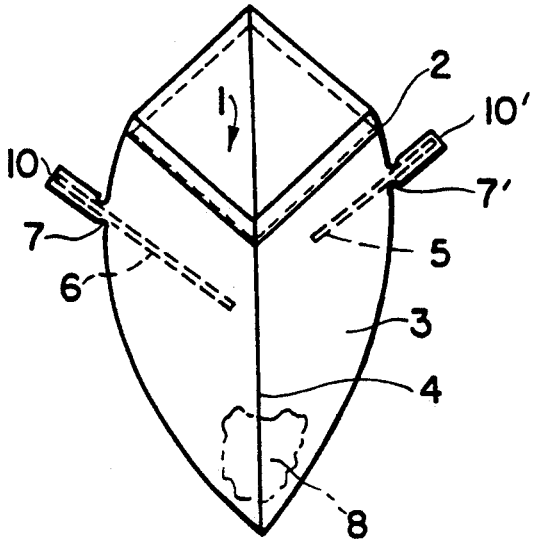
FIG. 5 is an upright side view of the seamed side 4 of the container, with the picked-up item 8 at the bottom of the container, and the scooping members 5 and 6 once again inside the container. The container may be reused to pickup additional items, by turning the scooping members to the outside, and once again repeating the procedure. After the first use, or following uses, the container may be sealed and carried to a place of disposal. Reuse may be necessary, e.g. when a dog defecates more than once during a walk period and the walker has only one device with them. In either case the container can be sealed and resealed after each pick-up is completed.

FIG. 5 is the container with the opening 1 facing upwards. The container is turned over so as to allow item(s) 8 to drop into the bottom of the container as the scooping members 5 and 6 are rotated and/or pivoted back into the container. The container may be sealed at 2 or reused as shown in FIG. 3 and/or FIG. 4, to pick up additional items 8. The scooping members 5 and 6 need only be rotated and/or pivoted back to the outside of the container to repeat the steps as previously outlined. The container is sealed at 2 when pick-up is completed.

Figure 6:
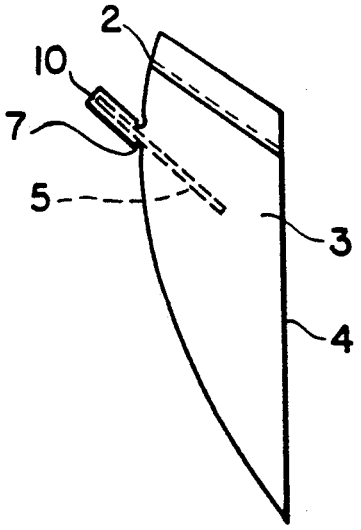
FIG. 6 shows the protruding gripping area 10, which is the upper end of the scooping member 5 and/or 6, at side 3 or 3' of the container. The scooping member 5 and/or 6 can be grasped f rom the outside of the container while the scooping means remain completely within the container. This eliminates the need to deal with and/or touch the soiled scoopers and allows all soiled matter to be sealed inside and within the container.

FIG. 6 shows one side of the container with the protruding area 10, which encases the gripping end of the scooping member 5, in the side 3 of the container. Thus the scooping members can be grasped from the outside of the container while they remain completely encased and inside the container. This eliminates the need to deal with, or touch soiled scoopers, and allows all soiled matter to be sealed inside and within the container.

In this preferred embodiment the scooping members 5 and 6 are flat. This facilitates packaging, storing and assembling of the present invention.

Figure 7:
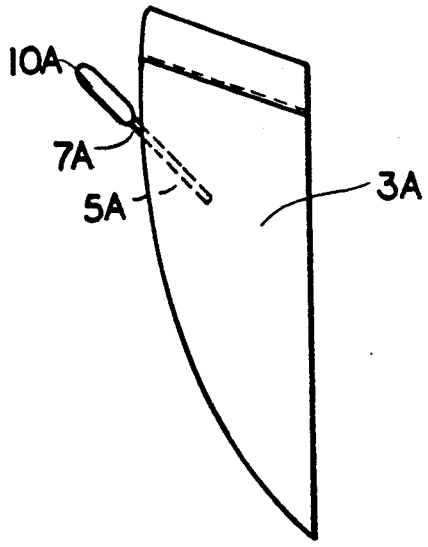
FIG. 7 shows the gripping or handle end 10A of scoops 5A or 6A pushed through a slit at the pivot point 7A of the container sides 3A and/or 3B (not shown). The scoops 5A and 6A (not shown) are held within the container at 7A and 7B (not shown) by sealing, pinning, stapling, gluing or some means of holding and/or attachment. The handle end should, of course, preferably be completely sealed in the area of its attachment to the container side.

FIG. 7 shows a plan view of one side of an embodiment with scoops 5A and/or 6A attached to the inside of container side 3A (or 3B, not shown) at pivot points 7A (and 7B, not shown). The top or gripping portion of the scoops 5A (and 6A, not shown) form the protrusion of the gripping areas 10A (and 10B, not shown). As heretofore mentioned the gripping areas of 10A (and 10B, not shown) may be pushed through a slit at the pivot point 7A (or 7B, not shown) of the container sides 3A (and 3B, not shown). The scooping members would be attached and sealed at this slit.

Figure 8:
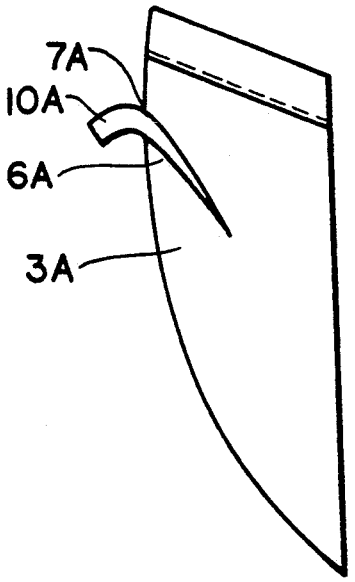
FIG. 8 shows the gripping end 10A and/or 10B (not shown) of the scooping members 5A and 5B (not shown) having an outward curved bend attached to the container in the area of pivot point 7A and/or 7B (not shown).

FIG. 8 shows one side of another preferred embodiment where the gripping end 10A (and 10B, not shown) of the scooping members 6A (and/or 5A, not shown) has an outward curved bend much like the area of a dinner plate between the bottom of the plate and the rim of the plate. This curved rim portion of the scooping members 6A (and 5A, not shown) are attached to the container sides 3A (and 3B, not shown) so as to form protrusions or handles and/or grips, 10A (and 10B, not shown). The scooping members 6A (and 5A, not shown) are then able to be grasped from the outside of the container. The curved bent edges or rim portion serve to give the scooping members 6A (and 5A, not shown) rigidity, lateral and longitudinal strength as well as ease of grasping and manipulation. The depth of the bend and the arc of the curve would be determined by taking into consideration the size of the container being used as needed by the size of the item 8 being picked up. In this embodiment the curved gripping portion could either be entirely encased within the container or could protrude through a slit in the container side and the slit be completely sealed.

The scooping member 6A (and 5A, not shown) are inside the container and are manipulated by the outside protrusion 10A (and 10B, not shown). The soiled portion of the scooping members 5A and 6A are never themselves touched, and are sealed within the container. This is important so as to eliminate contamination.

Figure 9:
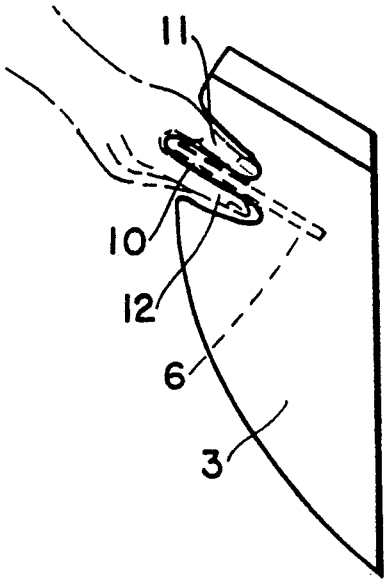
FIG. 9 shows the container side 3 with a pocket 11 above and a pocket 12 below the position at which the gripping end 10 and 10' is positioned at the side of the container 3 or 3'.

FIG. 9 shows one side of the container with the gripping end 10 (and/or 10', not shown) of the scooping member 6 (and/or 5, not shown), in the side 3 (or 3', not shown) of the container. In this embodiment the side 3 (and/or 3', not shown) has a pocket 11 (and/or 11', not shown) above and a pocket 12 (and/or 12', not shown) below the position at which the gripping end 10 (and/or 10', not shown) is attached to the side of the container 3 (or 3', not shown). Said pockets being open only from the exterior of the container so as to enable the insertion of the thumb and finger(s) respectively to grasp the gripping end 10 or 10' (not shown) of each scooping member 5 (not shown) and 6.

Figure 10:
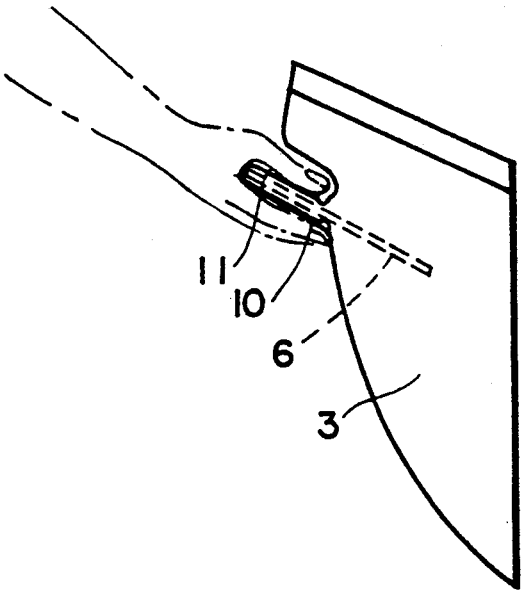
FIG. 10 shows the container side 3 with a pocket 11 above the position at which the gripping end 10 or 10' is positioned at the side of the container 3 or 3'.

FIG. 10 shows one side of the container with the gripping end of the scooping member 6 (or 5, not shown), in the side 3 (or 3', not shown) of the container. In this embodiment the side 3 (and/or 3', not shown) has a pocket 11 (or 11', not shown) above the position at which the gripping end 10 is attached to the side of the container 3 (or 3', not shown). Said pocket being open only from the exterior of the container to enable the insertion of the thumb (or other finger(s)) to grasp the gripping end 10 (or 10', not shown) of each scooping member 6 (or 5, not shown) .

In all of the embodiments the sides of the container, for example, around the gripping portion of the scooping member, can be of a more flexible consistency than the remainder of the container. This increased flexibility permits the easier grasping and manipulation of the gripping portion of the scoops.

I claim:

1. A bag or container for the sanitary collection or storage of items comprising:
(a) a bag having a sealable opening at the top thereof,
(b) a pair of cooperating, substantially rigid scooping members mounted entirely within the bag, each having a gripping end and a scooping end, and each attached in the vicinity of their gripping end to opposite walls on the inside of the bag with their scooping ends directed downwardly to the inside bottom of the bag,
(c) means for gripping and manipulating the scooping members by gripping them at their griping end, from the outside of the bag wall,
(d) the attachment of the gripping end being in the vicinity of the mouth of the bag
whereby said scooping members are adapted to be gripped from the outside of the bag and the scooping ends pivoted from their position of being directed downwardly to the inside of the bag bottom to a position upwardly and out of the opening of the bag, and further adapted to scoop items up by the cooperating scooping members, and the item and scooping members then pivoted back into a position of being entirely enclosed in the bag.

2. A bag or container according to claim 1 having an area of flexibility in the vicinity of the position where the scooping members are attached to the bag wall to permit gripping and rotation of the scooping members.

3. A bag according to claim 1 in which said means for gripping the scooping members comprise a handle portion of the gripping end of the scooping member, said handle portion being on the outside of the plane of the bag wall and the bag wall being sealed around the remaining portion of each scooping member inside the bag.

4. A bag according to claim 1 wherein said scooping members are of different size.

5. A bag according to claim 1 wherein said gripping end of the scooping members are fully encased in each side of the bag, with a portion of the bag side protruding outwardly from the plane of the bag side and wrapped around the end of the scooping members, whereby the gripping ends of the scooping members are easily grasped as they protrude beyond the plane of the bag side.

6. A bag according to claim 1 in which said gripping means comprise a sloping or curved rim gripping portion of each scoop member whereby the scooping member can be readily grasped at its gripping means from the outside of the bag.

7. A bag according to claim 1 wherein said bag has pockets above and below the position at which the gripping end is attached to the side of the bag, said pockets being open only from the exterior of the bag wall to enable the insertion of the fingers and thumb to grasp the gripping end of each scooping member.

8. A bag according to claim 1 wherein said bag has a pocket in the bag wall above the position at where the gripping end of each scooping member is attached to the inside of the bag, said pocket being open only from the exterior of the bag wall to enable insertion of a thumb, thereby facilitating the grasping of the gripping edge of each scooping member.

9. A bag according to claim 1 which is of an elongated structure whereby previously collected debris can be entrapped by the folding over of the bottom of the bag when a further collection of debris is carried out.

10. A bag or container for the sanitary collection or storage of items comprising:

(a) a bag having a sealable opening at the top thereof, (b) a pair of cooperating, substantially rigid scooping members, each having a gripping end and a scooping end, and each attached in the vicinity of their gripping end to opposite walls inside of the bag with their scooping ends directed downwardly to the inside bottom of the bag, (c) wherein said gripping end of the scooping members are fully encased in each side of the bag, with a portion of the bag side protruding outwardly from the plane of the bag side and wrapped around the gripping end of the scooping members, whereby the gripping ends of the scooping members are easily grasped as they protrude beyond the plane of the bag side, (d) the attachment of the gripping end being in the vicinity of the mouth of the bag.

whereby said scooping members are adapted to be gripped from the outside of the bag and the scooping members pivoted from their position of being directed downwardly toward the inside of the bag bottom to a position upwardly and out of the opening of the bag, and further adapted to scoop items up by the cooperating scooping members, and the item and scooping members then pivoted back into the bag.

11. A bag according to claim 10 wherein said bag also has a pocket in the bag wall on a position below the position at which the griping end is attached to the side of the bag, said pocket being open only from the exterior of the bag to enable insertion of the fingers and thumb to grasp the gripping end of each scooping member.

12. A bag or container for the sanitary collection or storage of items comprising:

(a) a bag having a sealable opening at the top thereof;

(b) a pair of cooperating, substantially rigid scooping members, each having a gripping end and a scooping end, and each attached in the vicinity of their gripping end to opposite walls inside of the bag with their scooping ends directed downwardly to the inside bottom of the bag, (c) wherein said bag has a pocket in the bag wall above the position at where the gripping end of each scooping member is attached to the inside of the bag, said pocket being open only from the exterior of the bag wall to enable insertion of a thumb, thereby facilitating the grasping of the gripping edge of each scooping member, (d) the attachment of the gripping end being in the vicinity of the mouth of the bag.

whereby said scooping members are adapted to be gripped from the outside of the bag and the scooping members pivoted from their position of being directed downwardly toward the inside of the bag bottom to a position upwardly and out of the opening of the bag, and further adapted to scoop items up by the cooperating scooping members, and the item and scooping members then pivoted back into the bag.

13. A bag or container for the sanitary collection of storage of items comprising:

(a) a bag having a sealable opening at the top thereof;

(b) a pair of cooperating, substantially rigid scooping members, each having a gripping end and a scooping end, and each attached in the vicinity of their gripping end to opposite walls of the bag with their scooping ends directed downwardly to the inside bottom of the bag, (c) the uppermost portion of said gripping ends protruding to the outside of the bag wall through a slit entirely sealing this uppermost portion from the remainder of the scooping member within the bag whereby said scooping members are adapted to be gripped from the outside of the bag and the scooping ends pivoted from their position of being directed downwardly to the inside of the bag bottom to a position upwardly and out of the opening of the bag, and further adapted to scoop items up by the cooperating scooping members, and the item and scooping members then pivoted back into the bag.

14. A bag according to claim 13 in which said gripping means comprise a sloping or curved rim gripping portion of each scoop member whereby the scooping member can be readily grasped at its uppermost gripping portion from the outside of the bag.

* * * * *